US008973221B2

(12) United States Patent
Bowman

(10) Patent No.: US 8,973,221 B2
(45) Date of Patent: Mar. 10, 2015

(54) GIFT BAG BAND

(75) Inventor: Linden H. Bowman, Ellicott City, MD (US)

(73) Assignee: The Lindy Bowman Company, Elkridge, MD (US)

( * ) Notice: Subject to any disclaimer, the term of this patent is extended or adjusted under 35 U.S.C. 154(b) by 184 days.

(21) Appl. No.: 13/584,604

(22) Filed: Aug. 13, 2012

(65) Prior Publication Data

US 2014/0041160 A1 Feb. 13, 2014

(51) Int. Cl.
*B65D 63/00* (2006.01)

(52) U.S. Cl.
USPC ..... 24/17 AP; 24/16 PB; 24/17 R; 24/457; 24/466

(58) Field of Classification Search
CPC ..... B31D 5/00; B31D 5/04; B54D 63/00
USPC ..... 24/17 R, 17 AP, 16 PB, 16 R, 17 A, 457, 24/466; 40/665; 211/113; 53/399
See application file for complete search history.

(56) References Cited

U.S. PATENT DOCUMENTS

| | | | | | |
|---|---|---|---|---|---|
| 1,210,952 | A * | 1/1917 | Krueger | ..... | 24/17 R |
| 3,495,760 | A * | 2/1970 | Poth | ..... | 294/137 |
| 3,664,572 | A * | 5/1972 | Puchkoff et al. | ..... | 229/103.2 |
| 3,913,179 | A | 10/1975 | Rhee | | |
| 5,479,681 | A * | 1/1996 | Muraoka | ..... | 24/16 R |
| 5,878,520 | A | 3/1999 | Milbrandt et al. | | |
| 6,045,263 | A | 4/2000 | Keller et al. | | |
| 6,901,636 | B2 * | 6/2005 | Kim | ..... | 24/17 A |
| 6,978,518 | B2 * | 12/2005 | Kim | ..... | 24/17 A |
| 7,310,857 | B2 * | 12/2007 | Kim | ..... | 24/17 A |
| 7,377,013 | B2 | 5/2008 | Cheung | | |
| 8,141,707 | B2 * | 3/2012 | Robbins et al. | ..... | 206/447 |
| 2003/0071045 | A1 * | 4/2003 | Taylor | ..... | 220/737 |
| 2005/0241964 | A1 * | 11/2005 | Taylor | ..... | 206/170 |
| 2011/0162997 | A1 * | 7/2011 | Robbins et al. | ..... | 206/746 |
| 2012/0030911 | A1 | 2/2012 | Bowman | | |

* cited by examiner

*Primary Examiner* — Robert J Sandy
*Assistant Examiner* — Louis Mercado
(74) *Attorney, Agent, or Firm* — Cahn & Samuels, LLP

(57) ABSTRACT

A gift bag band includes an elongated body portion including a first end and a second end, a first fastener on the first end, and a complementary second fastener on the second end for releasably engaging the first fastener. The band further includes a flap cut out from the elongated body portion, wherein the flap has an aperture dimensioned to receive a display hook. The band includes at least one upper fold and at least one lower fold. The upper and lower folds segment the elongated body portion into a front segment, an upper back segment, and a lower back segment. The front segment lies in a first plane, and the upper and lower back segments lie on a second plane substantially parallel to the first plane. The flap is cut from the second plane and lies on the first plane.

15 Claims, 6 Drawing Sheets

GIFT BAG BAND

This patent application claims priority to U.S. patent application Ser. No. 29/415,993 filed on Mar. 16, 2012, which is hereby incorporated by reference.

I. DESCRIPTION OF THE TECHNICAL FIELD

This invention relates to an improvement in bands for retaining gift bags, pouches, sacks, and other like articles, and more particularly to a flexible band having an elongated body portion with complementary fasteners on opposite ends thereof, and a hanging flap cut out from the elongated body portion.

II. BACKGROUND OF THE INVENTION

In recent years, there has been a tremendous growth in the manufacture and sale of containers, particularly decorative containers for receiving and holding objects, such as gift objects. One form of such containers is a decorative bag that is adapted to receive a gift item, which eliminates the need to place the items in separate boxes that are usually subsequently wrapped with gift wrapping paper. Instead, gift items may be "wrapped" in the bag and hidden from view using such items as tissue paper, confetti, bag stuffing, shredded ribbons, and the like. Typically these decorative or gift bags have ornamental designs on their surface containing indicia relating to a season, event or in some way relevant and/or endearing to the intended recipient of the gift.

U.S. Pat. No. 7,377,013 issued to Cheung discloses an adjustable and detachable binding device that includes an elongated binding member, a plurality of locking holders spacedly and integrally formed along a tail portion of the binding member, and a loop locker integrally formed at a head portion of the binding member to detachably engage with one of the locking holders to form a binding loop of the binding member for fittingly binding up an object. The loop locker is shaped and sized that enables the loop locker to be detachably engaged with the respective locking holder, so as to adjust a diameter of the binding loop of the binding member with respect to the object.

U.S. Pat. No. 3,913,179 issued to Rhee discloses an adjustable, pliable tie strap comprising a series of longitudinal slot means at one end of the strap and a tongue portion at the opposite end containing notch means. The tongue portion can be inserted in any of the said slots for tying or securing an object.

U.S. Pat. No. 5,878,520 issued to Milbrandt, et al. discloses an advertising band for quick and easy locking, unlocking and re-locking about merchandise is a flexible strip having a lead end section, a body section, and a tail end section. The lead end section is equipped with a lock aperture having a maximum dimension in the longitudinal direction and a minimum dimension transverse thereto. The body section has a substantial length and transverse width for displaying advertising information. Its length is at least as great as the combined length of both the lead and the tail end sections. The tail end section has laterally paired locking members separated by neck members along its length. It is easily pulled through the aperture to lock any pair of the locking members against the minimum dimension edges of the aperture and yet is easily and quickly unlocked from the aperture by aligning its locking members with the maximum dimension of the aperture and pulling it free from the aperture.

U.S. Pat. No. 6,045,263 issued to Keller, et al. discloses a gift package that comprises a bag having generally parallel front and rear walls, each having a top edge, a bottom edge, and two lateral edges, a pair of generally parallel side walls, each having a top edge, a bottom edge, and two lateral edges, wherein the lateral edges of the front and rear walls are joined to the lateral edges of the side panels, and a bottom panel having two pairs of generally parallel lateral edges, wherein the lateral edges of the bottom panel are joined to the bottom edges of the front, rear, and side walls to form a container having an opening defined by the top edges of the front, rear, and side walls, and wherein the bag has an expanded state and a collapsed state, where an area of the bag opening is larger when the bag is in its expanded state than when the bag is in its collapsed state. The gift bag further comprises a bag topper comprising a resilient member having a length and a width, wherein the resilient member has a relaxed state and a compressed state, wherein the bag topper in the compressed state is smaller in at least one of the length and width than when the bag topper is in the relaxed state, so that the bag topper urges the opening of the bag toward the expanded state of the bag as the bag topper moves from the compressed state of the bag topper to the relaxed state of the bag topper.

III. SUMMARY OF THE INVENTION

The invention relates to a band for retaining articles secured therein having a novel structure.

It is an object of the invention to provide a band for bundling and storing articles, particularly articles having a similar size.

It is another object of the invention to provide a band for displaying the articles, and particularly for presenting the articles to consumers in a retail environment.

It is yet another object of the invention to provide a band for hanging the articles on, for example, a sales rack and maintaining the articles at a select height from the floor.

It is still another object of the invention to provide a band for hanging the articles for storage, wherein multiple bands can be utilized to stow articles in an organized manner.

Certain of these and other objects are satisfied by a band having an elongated body portion including a first end and a second end, a first fastener on the first end, and a complementary second fastener on the second end for releasably engaging the first fastener. In one embodiment, the first fastener is a T-tab, and the second fastener is a slot dimensioned to receive and removably secure the T-tab to the second end.

The band further includes a hanging flap cut out from the elongated body portion, wherein the flap has an aperture dimensioned to receive a display hook. The flap can include a first end connected to the elongated body portion, a second end parallel and opposite the first end, a third end perpendicular to the first end, and a fourth end parallel and opposite the third end.

In at least one embodiment of the invention, the flap can be formed between a first cut portion, a second cut portion, and a third cut portion. The first cut portion is parallel with the first end and the second end of the elongated body portion, wherein the first cut portion is proximate to a top edge of the flap, and wherein the first cut portion has a first end and a second end. The second cut portion is contiguous with the first end of the first cut portion, wherein the second cut portion is perpendicular to the first cut portion, and wherein the second cut portion is proximate a first side edge of the flap. The third cut portion is contiguous with the second end of the first cut portion, wherein the third cut portion is perpendicular to the first cut portion and parallel with the second cut portion, and wherein the third cut portion is proximate a second side edge of the flap.

Furthermore, the band includes at least one upper fold proximate the flap, and at least one lower fold proximate the second end of the elongated body portion. The upper and lower folds segment the elongated body portion into a front segment, an upper back segment, and a lower back segment. The front segment lies in a first plane, wherein the upper back segment and the lower back segment lie on a second plane substantially parallel to the first plane. The flap is cut from the second plane and lies on the first plane.

The front segment connects the upper back segment to the lower back segment, wherein the first fastener is on the upper back segment and the second fastener is on the lower back segment. The upper back segment is further connected to the lower back segment by the first fastener and the second fastener.

For definitional purposes and as applicable, the term "hook" as used herein is intended to mean an apparatus for hanging items thereon, wherein the "hook" may be in the form of a rack, bar, rod, dowel or other like apparatus.

As used herein, the term "aperture" is intended to mean a feed-through dimensioned to receive and retain a hook therein, which may be in the form of an hole, opening, orifice, pass-through, passage, perforation, slit, slot, and the like.

As used herein, the singular forms "a", "an", and "the" are intended to include the plural forms as well, unless the context clearly indicates otherwise.

As used herein "substantially," "generally," and other words of degree are relative modifiers intended to indicate permissible variation from the characteristic so modified. It is not intended to be limited to the absolute value or characteristic which it modifies but rather possessing more of the physical or functional characteristic than its opposite, and preferably, approaching or approximating such a physical or functional characteristic.

In the following description, reference is made to the accompanying drawing which is shown by way of illustration to the specific embodiments in which the invention may be practiced. The following illustrated embodiments are described in sufficient detail to enable those skilled in the art to practice the invention. It is to be understood that other embodiments may be utilized and that structural changes based on presently known structural and/or functional equivalents may be made without departing from the scope of the invention.

IV. BRIEF DESCRIPTION OF THE DRAWING

V. DETAILED DESCRIPTION OF THE EMBODIMENTS

Figure 1:
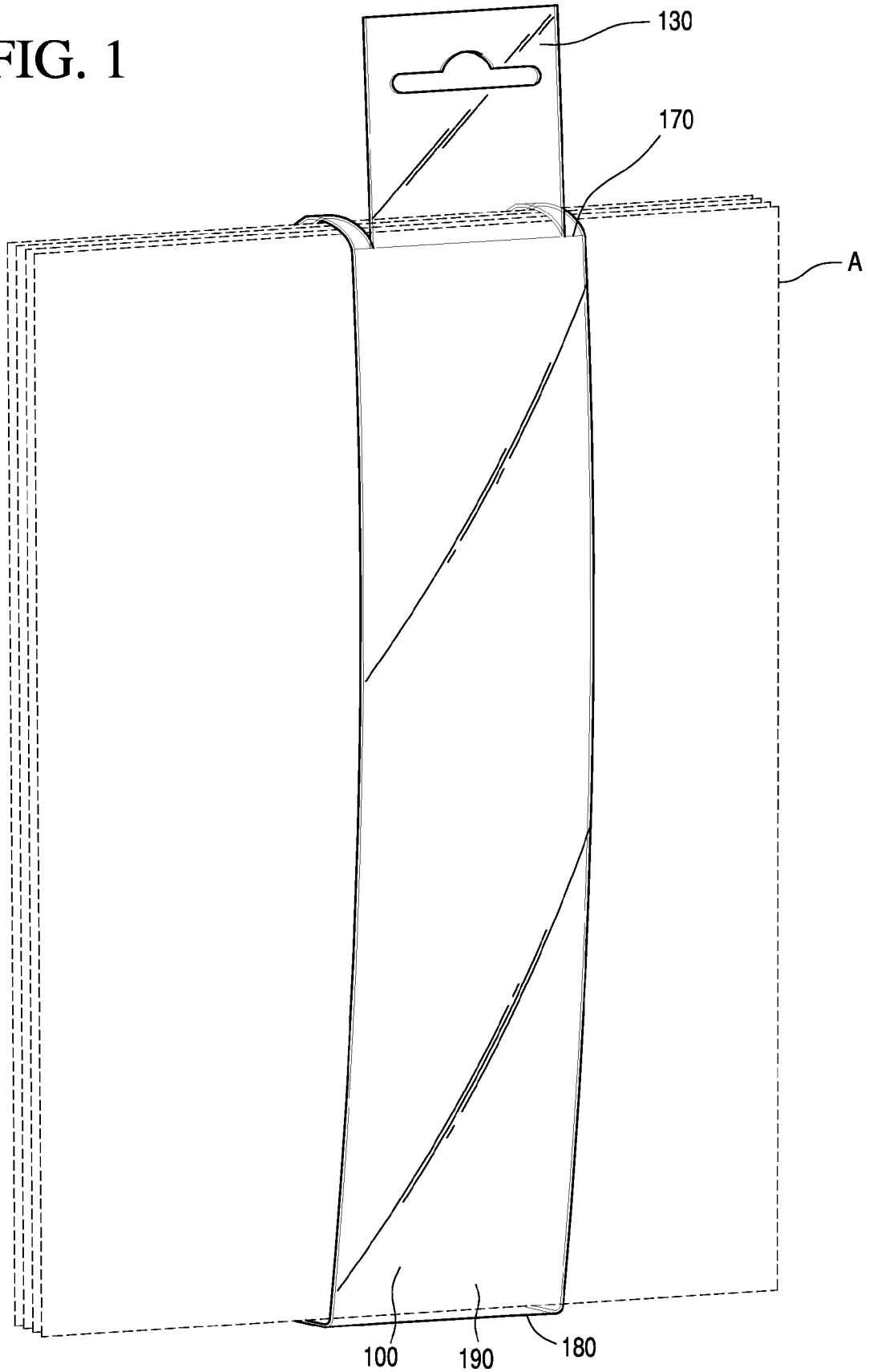
FIG. 1 is a front perspective assembly view showing a band and ghosted gift bags according to an embodiment of the invention.

Referring now to the figures, wherein like reference numbers denote like components, elements, or features through the various illustrated embodiments discussed in detail below, the invention is a device including a container and a strap. While specific implementations of the disclosed technology are discussed, it should be understood that this is done for illustration purposes only. A person skilled in the relevant art will recognize that other components and configurations may be used without departing from the spirit and scope of the invention.

FIGS. 1-18 illustrate a device for retaining and displaying articles according to an embodiment of the invention, wherein the device (also referred to herein as a "band" or "strap") has an elongated body portion 100. In at least one embodiment, the elongated body portion 110 is substantially rectangular-shaped (when in an un-folded configuration) and formed from a flexible material such as, for example, plastic or cardboard. The elongated body portion 100 has a first end 110 and a second end 120, wherein the first end 110 is parallel to the second end 120. The elongated body portion 110 further includes a first side edge that is parallel to a second side edge.

The device further includes a first fastener 112 on the first end 110 and a complementary second fastener 122 on the second end 120 for releasably engaging the first fastener 112. The first fastener 112 and second fastener 122 are mating elements for connecting the first end 110 and second end 120 of the device, such that the elongated body portion 100 forms a closed loop for retaining articles within the device. In at least one embodiment, the first fastener 112 is a T-tab and the second fastener 122 is a slot dimensioned to receive and removably secure the T-tab to the second end 120. In other embodiments, the first fastener 112 and second fastener 122 could include hook and loop fasteners, adhesives, snaps, and/or buckles.

As illustrated in FIG. 1, the device can be used to hold and secure articles A therein, for purposes such as storage or retail packaging. The device can be particularly useful for bundling and holding flat, folded, and/or stacked articles, such as, for example, sheets of material, magazine, paper bags, decorative gift bags, etc.

In addition, the device includes a flap 130 (also referred to herein as a "hanging flap") cut out from the elongated body portion 100 by which the band and its contents may be hanged from a rack, hook, bar, rod, or other like device (referred to herein as an "elongated hanging apparatus" or a "display hook"). More specifically, the flap 130 includes an aperture 131 dimensioned to receive and retain a portion of an elongated hanging apparatus therein, such that the elongated hanging apparatus passes through the aperture 131 and secures the band and its contents thereon via friction.

Although the FIGS. illustrate that the aperture 130 is butterfly-shaped, it is contemplated in other embodiments that the aperture 130 could comprise other shapes, such as circular, semi-circular, oblong, etc. In another embodiment, the aperture 131 is replaced with a notch (not shown). The notch is a hook or J-shaped cut-out dimensioned to receive and retain a portion of an elongated hanging apparatus therein, such that the elongated hanging apparatus passes through the notch and secures the band and its contents thereon via friction. The position of the flap 130, which extends above and away from the band, allows multiple bands to be hung from a single hook, wherein the bands and their contents are positioned below and away from their respective connection points to the hook.

Figure 2:
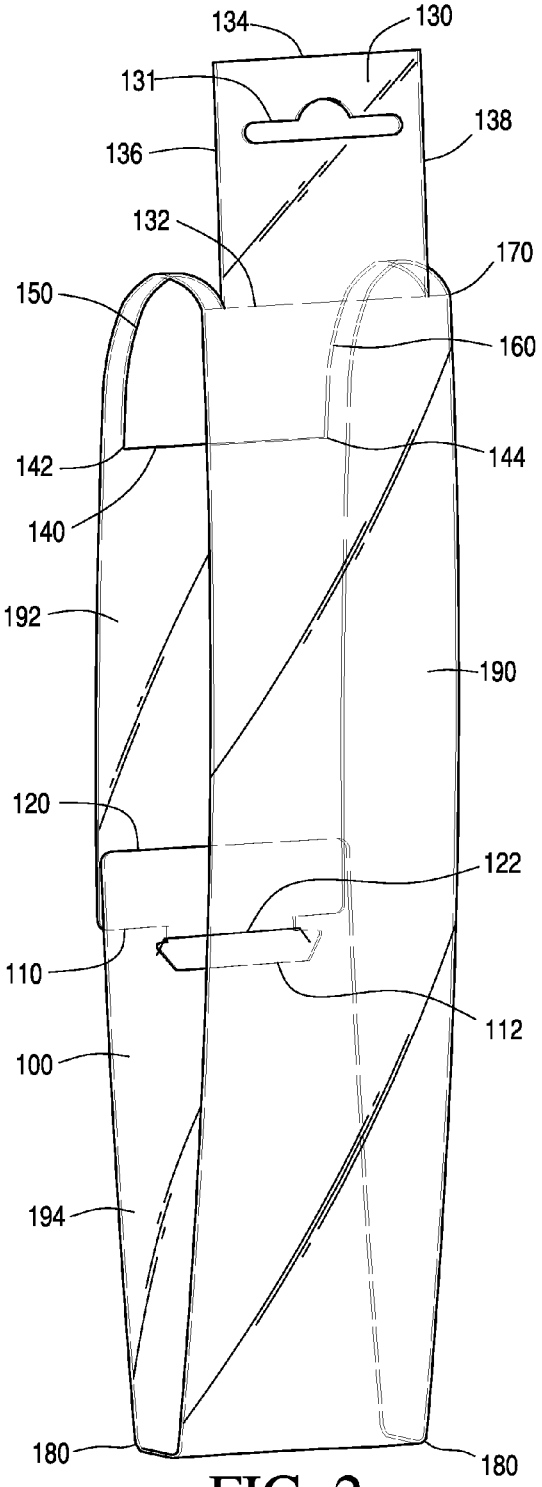
FIG. 2 is a right rear perspective view showing a band according to an embodiment of the invention.
Figure 3:
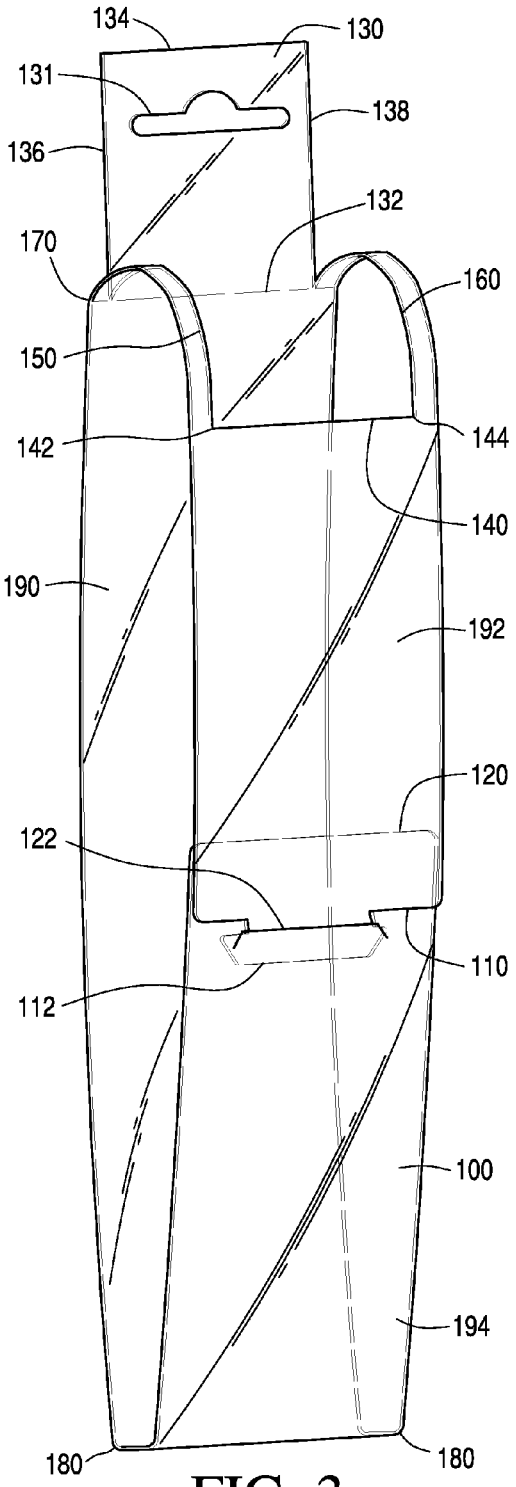
FIG. 3 is a left rear perspective view showing a band according to an embodiment of the invention.
Figure 4:
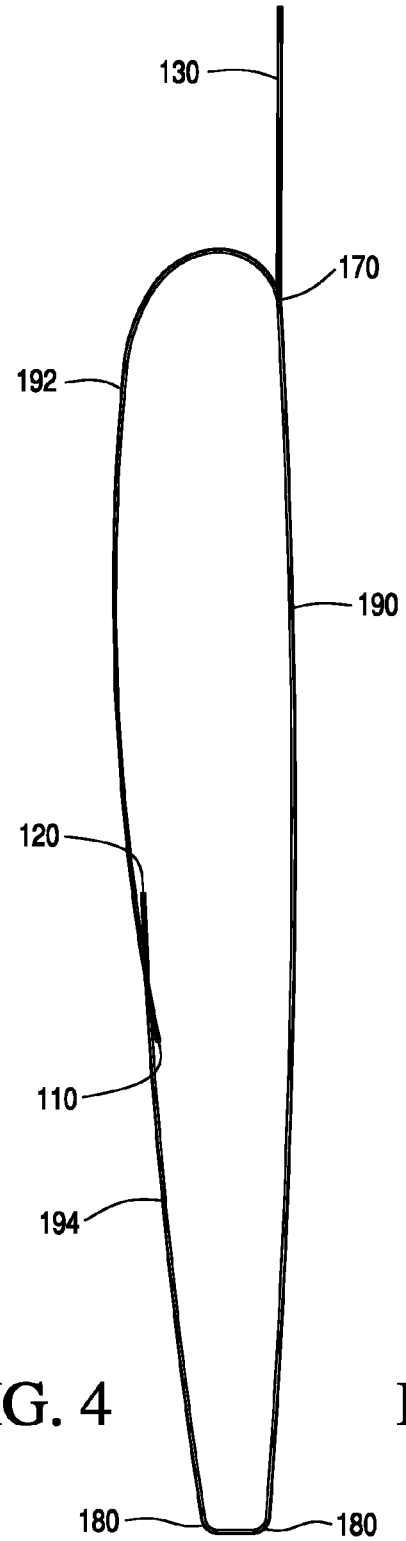
FIG. 4 is a left side view of a band according to an embodiment of the invention.
Figure 5:
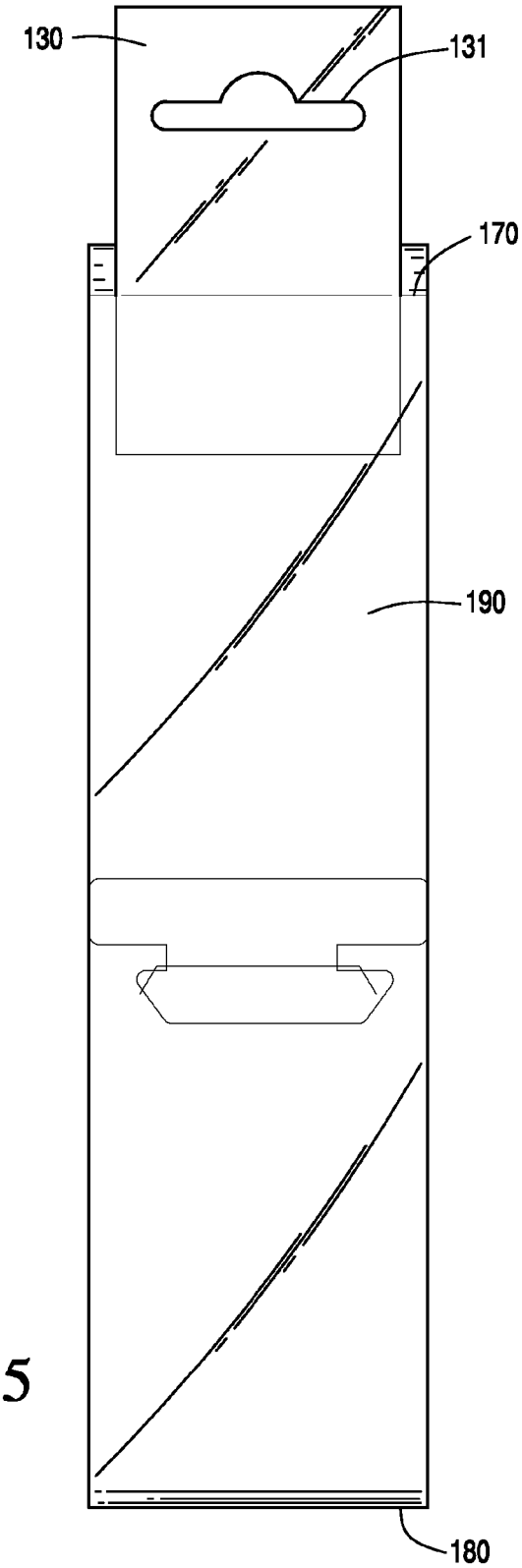
FIG. 5 is a front view of a band according to an embodiment of the invention.
Figure 6:
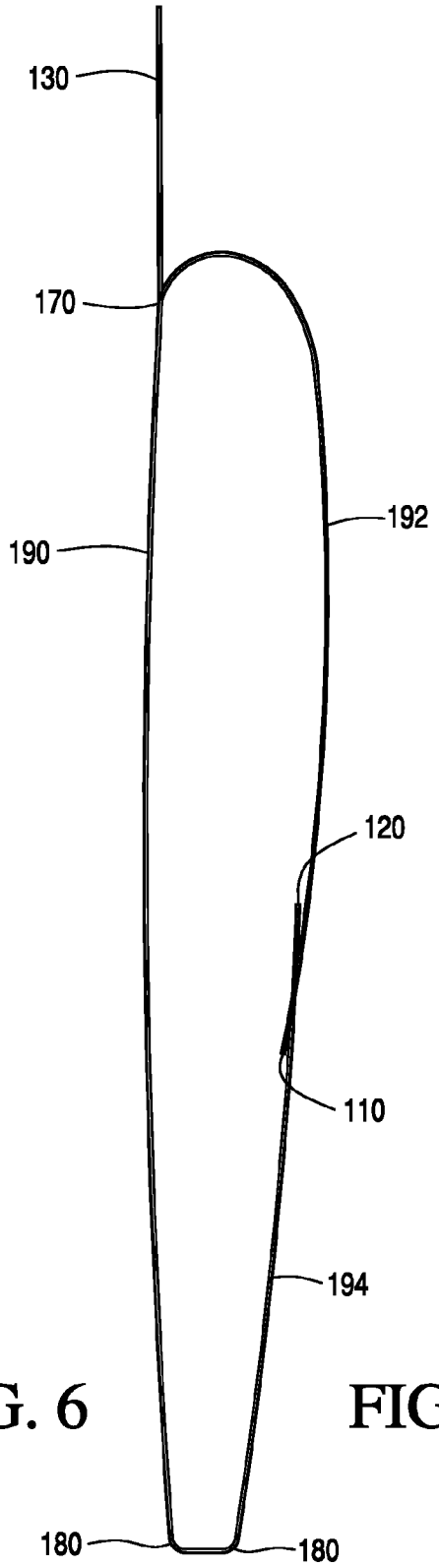
FIG. 6 is a right side view of a band according to an embodiment of the invention.
Figure 7:
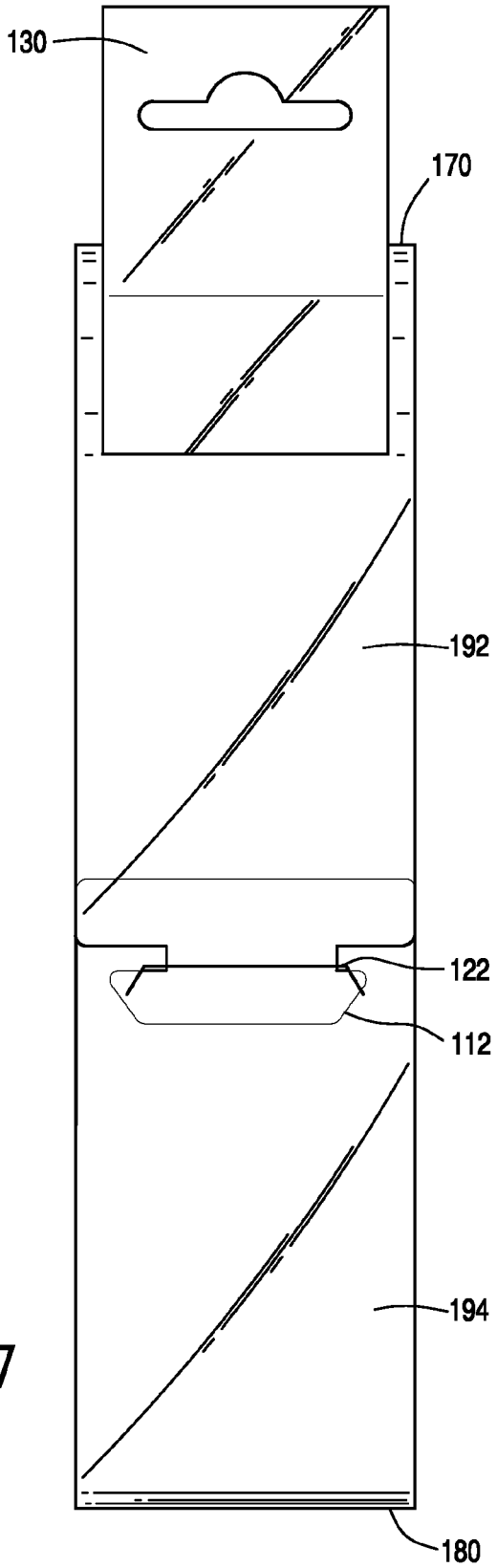
FIG. 7 is a rear view of a band according to an embodiment of the invention.
Figure 8:
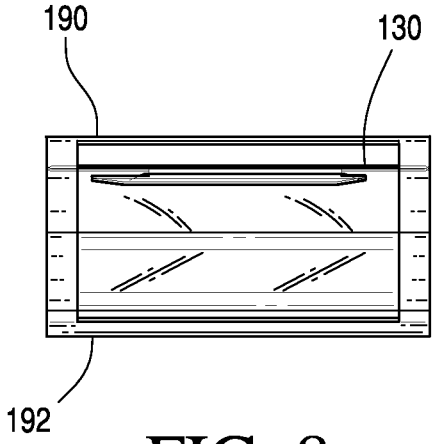
FIG. 8 is a top view of a band according to an embodiment of the invention.
Figure 9:
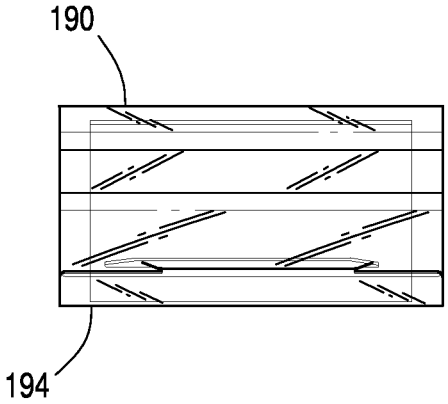
FIG. 9 is a bottom view of a band according to an embodiment of the invention.

In at least one embodiment of the invention, as illustrated in FIGS. 2-3, the flap 130 has a substantially rectangular shape and includes a first end 132 and a second end 134, wherein the first end 132 is connected to the elongated body portion 100, and wherein the second end 134 is parallel and opposite the first end 132. The flap 130 can further include a third end 136 and a fourth end 138, wherein the third end 136 is perpendicular to the first end 132, and wherein the fourth end 138 is parallel and opposite the third end 136. It is contemplated in another embodiment that the flap 130 could have a different shape such as, for example, a triangle, circle, or semicircle.

As illustrated in FIGS. 2-3, the flap 130 is formed (lies) between a first cut portion 140, a second cut portion 150, and a third cut portion 160. The cut portions (also referred to herein as "straight edges") are slits that are cut in the elongated body portion 100. The first cut portion 140 is parallel with the first end 110 and the second end 120 of the elongated body portion 100. When the strap is in an unfolded, flat configuration, the first cut portion 140 is proximate a top edge of the flap 130 (i.e., the second end 134). The first cut portion 140 has a first end 142 and a second end 144, wherein the second cut portion 150 is contiguous with the first end 142 of the first cut portion 140. The second cut portion 150 is perpendicular to the first cut portion 140, and is proximate a first side edge of the flap 130 (i.e., the third end 136).

The third cut portion 160 of the elongated body portion 100 is contiguous with the second end 144 of the first cut portion 140, and is proximate a second side edge of the flap 130 (i.e., the fourth end 138). The third cut portion 160 is perpendicular to the first cut portion 140 and parallel with the second cut portion 150. Thus, the first cut portion 140, second cut portion 150, and third cut portion 160 form a block-shaped (right angles, no curved) "U".

In at least one embodiment of the invention, the elongated body portion 100 is cut to form the first cut portion 140, the second cut portion 150, and the third cut portion 160. In another embodiment, the elongated body portion 100, the first cut portion 140, the second cut portion 150, the third cut portion 160, and flap 130 are simultaneously formed via injection molding.

As illustrated in FIGS. 1-7, the elongated body portion 100 further includes one or more upper folds 170 proximate the flap 130 and one or more lower folds 180 proximate the second end 120 of the elongated body portion 100. Although FIGS. 2-4 and 6 illustrate that the elongated body portion 100 includes one upper fold 170 and two lower folds 180, it is contemplated in alternative embodiments that other numbers and configurations of upper and lower folds could be implemented, depending on the number and thickness of articles to be retained within the band. For example, if thicker and/or a greater amount of articles are to be retained within the band, then more folds could be utilized. Conversely, if thinner and/or a smaller amount of articles are to be retained within the band, then more only one upper fold 170 and one lower fold 180 folds could be employed.

The upper fold 170 and lower folds 180 segment the elongated body portion 110 into a front segment 190, an upper back segment 192, and a lower back segment 194. The front segment 190 lies in a first plane; and, the upper back segment 192 and the lower back segment 194 lie on a second plane substantially parallel to the first plane, wherein the first and second planes are separated by a select distance. The flap 130 is cut from the second plane and lies on the first plane. In other words, the flap 130 is cut from the upper back segment 192 (which lies in the second plane) and lies on the same plane as the front segment 190 (i.e., the first plane) when the strap is in a folded configuration (i.e., the first fastener 112 is engaged with the second fastener 122).

The front segment 190 connects the upper back segment 192 to the lower back segment 194. The first fastener 112 is on the upper back segment 192; and, the second fastener 122 is on the lower back segment 194. The upper back segment 192 is further connected to the lower back segment 194 by the first fastener 112 and the second fastener 194. In at least one embodiment, the elongated body portion 100, first fastener 112, second fastener 122, and flap 130 are integrally formed and embody a single unitary structure formed from the same material.

Figure 10:
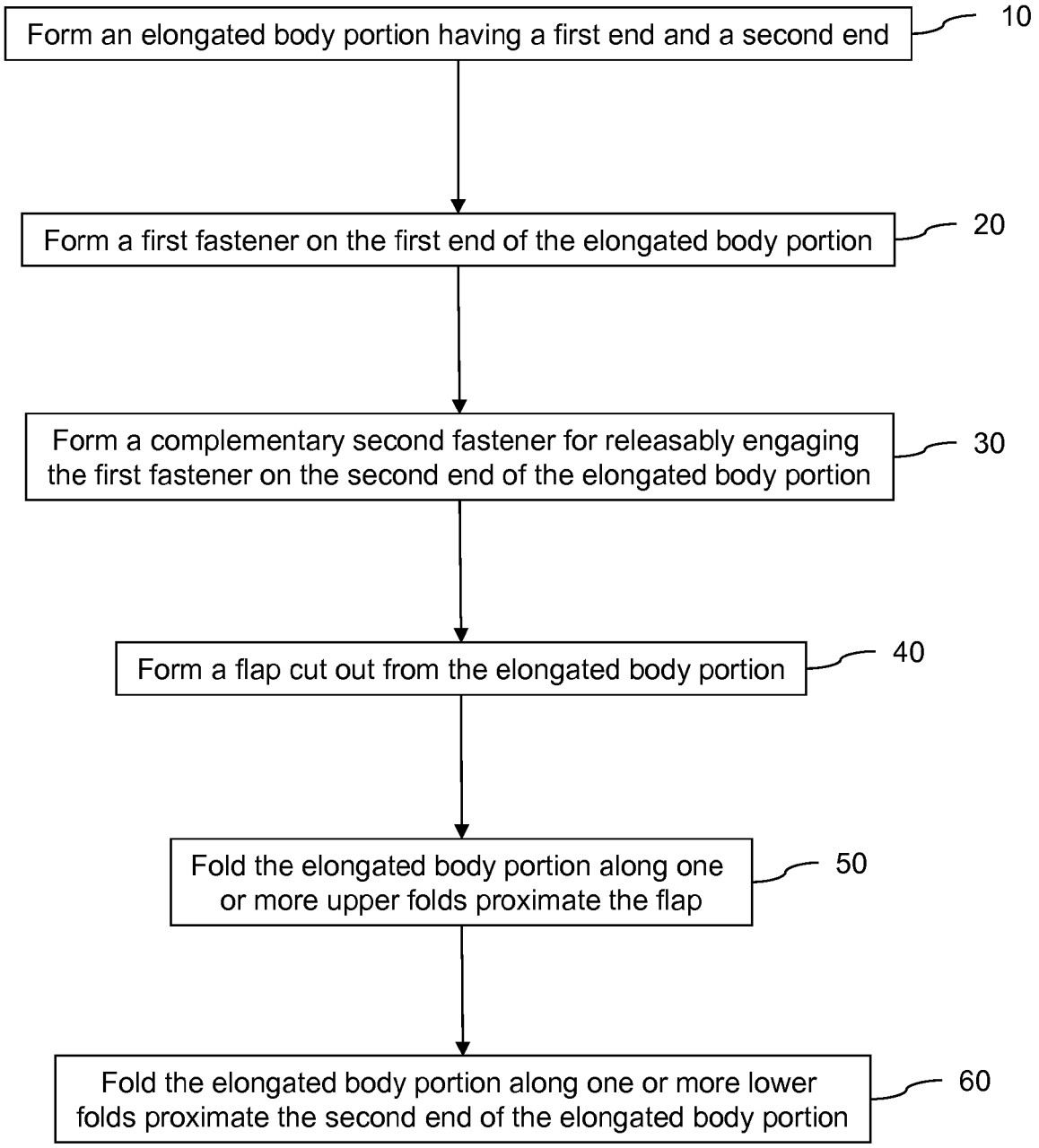
FIG. 10 is a flow diagram illustrating a method for forming a device according to an embodiment of the invention.

FIG. 10 is a flow diagram illustrating a method for forming the device according to an embodiment of the invention. An elongated body portion having a first end and a second end is formed 10. The elongated body portion 110 can be substantially rectangular-shaped (when in an un-folded configuration) and formed from a flexible material such as, for example, plastic or cardboard.

A first fastener is formed on the first end of the elongated body portion 20; and, a complementary second fastener for releasably engaging the first fastener is formed on the second end of the elongated body portion 30. In at least one embodiment, the first fastener is a T-tab and the complementary second fastener is a slot dimensioned to receive and removably secure the T-tab to the second end.

In addition, a flap cut out from the elongated body portion is formed 40, wherein the flap includes an aperture or a notch dimensioned to receive a display hook. In at least one embodiment, the elongated body portion, first fastener, second fastener, and flap are formed simultaneously, wherein the elongated body portion, first fastener, second fastener, and flap are integrally formed and embody a single unitary structure formed from the same material. As described above, the elongated body portion can be cut to form the flap. In another embodiment, the elongated body portion, a first cut portion, a second cut portion, a third cut portion, and the flap are simultaneously formed via injection molding.

The elongated body portion is folded along one or more upper folds that are proximate to the flap 50. The elongated body portion is also folded along one or more lower folds that are proximate to the second end of the elongated body portion 60. Folding the elongated body portion at the upper and lower folds segment the elongated body portion into a front segment, an upper back segment, and a lower back segment. The front segment lies in a first plane; and, the upper and lower back segments lie on a second plane substantially parallel to the first plane. The flap is cut from the second plane and lies on the first plane.

Although specific example embodiments have been illustrated and described herein, those of ordinary skill in the art appreciate that other variations, aspects, or embodiments may be contemplated, and/or practiced without departing from the scope or the spirit of the appended claims.

The invention claimed is:

1. A device comprising:

an elongated body portion comprising a first end and a second end;

a first fastener on said first end;

a complementary second fastener on said second end, said complementary second fastener for releasably engaging said first fastener; and a flap cut out from said elongated body portion between said first end and said second end, wherein said flap comprises at least one of an aperture and a notch dimensioned to receive a display hook;

wherein said first fastener comprises a T-tab, and wherein said second fastener comprises a slot dimensioned to receive and removably secure said T-tab to said second end.

2. The device according to claim 1, further comprising:

at least one upper fold proximate said flap; and at least one lower fold proximate said second end of said elongated body portion.

3. The device according to claim 2, wherein said at least one upper fold and said at least one lower fold segment said elongated body portion into a front segment, an upper back segment, and a lower back segment.

4. The device according to claim 3, wherein said front segment lies in a first plane, wherein said upper back segment and said lower back segment lie on a second plane substantially parallel to the first plane, and wherein said flap is cut from the second plane and lies on the first plane.

5. The device according to claim 3, wherein said front segment connects said upper back segment to said lower back segment, wherein said first fastener is on said upper back segment and said second fastener is on said lower back segment, and wherein said upper back segment is further connected to said lower back segment by said first fastener and said second fastener.

6. The device according to claim 1, wherein said flap comprises:

a first end connected to said elongated body portion;

a second end parallel and opposite said first end;

a third end perpendicular to said first end; and a fourth end parallel and opposite said third end.

7. The device according to claim 1, wherein said flap is formed between a first cut portion, a second cut portion, and a third cut portion, wherein said first cut portion is parallel with said first end and said second end of said elongated body portion, said first cut portion is proximate a top edge of said flap, and said first cut portion has a first end and a second end, wherein said second cut portion is contiguous with said first end of said first cut portion, said second cut portion is perpendicular to said first cut portion, and said second cut portion is proximate a first side edge of said flap, wherein said third cut portion is contiguous with said second end of said first cut portion, said third cut portion is perpendicular to said first cut portion and parallel with said second cut portion, and said third cut portion is proximate a second side edge of said flap.

8. A device for retaining articles, said device comprising:

an elongated body portion comprising a first end and a second end;

a first fastener on said first end;

a complementary second fastener on said second end, said complementary second fastener for releasably engaging said first fastener;

a hanging flap cut out from said elongated body portion between said first end and said second end, wherein said hanging flap comprising at least one of an aperture and a notch dimensioned to receive a display hook;

at least one upper fold proximate said hanging flap;

at least one lower fold proximate, said at least one upper fold and said at least one lower fold segment said elongated body portion into a front segment, an upper back segment, and a lower back segment, said front segment lies in a first plane, said upper back segment and said lower back segment lie on a second plane substantially parallel to the first plane, said hanging flap being cut from the second plane and lying on the first plane, wherein said first fastener comprises a T-tab, and wherein said second fastener comprises a slot dimensioned to receive and removably secure said T-tab to said second end.

9. The device according to claim 8, wherein said front segment connects said upper back segment to said lower back segment, wherein said first fastener is on said upper back segment and said second fastener is on said lower back segment, and wherein said upper back segment is further connected to said lower back segment by said first fastener and said second fastener.

10. The device according to claim 8, wherein said hanging flap comprises:

a first end connected to said elongated body portion;

a second end parallel and opposite said first end;

a third end perpendicular to said first end; and a fourth end parallel and opposite said third end.

11. The device according to claim 8, wherein said hanging flap is formed between a first cut portion, a second cut portion, and a third cut portion, wherein said first cut portion is parallel with said first end and said second end of said elongated body portion, said first cut portion is proximate a top edge of said hanging flap, and said first cut portion has a first end and a second end, wherein said second cut portion is contiguous with said first end of said first cut portion, said second cut portion is perpendicular to said first cut portion, and said second cut portion is proximate a first side edge of said hanging flap, wherein said third cut portion is contiguous with said second end of said first cut portion, said third cut portion is perpendicular to said first cut portion and parallel with said second cut portion, and said third cut portion is proximate a second side edge of said hanging flap.

12. A method for forming a device, said method comprising:

forming an elongated body portion having a first end and a second end;

forming a first fastener on the first end, wherein said forming of the first fastener comprises forming a T-tab;

forming a complementary second fastener on the second end, the complementary second fastener for releasably engaging the first fastener, wherein said forming of the complementary second fastener comprises forming a slot dimensioned to receive and removably secure the T-tab to the second end; and forming a flap cut out from the elongated body portion between the first end and the second end, wherein said forming of the flap comprises forming one of an aperture and a notch dimensioned to receive a display hook.

13. The method according to claim 12, further comprising:

folding the elongated body portion along at least one upper fold proximate the flap; and folding the elongated body portion along at least one lower fold proximate the second end of the elongated body portion, wherein said folding of the elongated body portion along the at least one upper fold and the at least one lower fold segment the elongated body portion into a front segment, an upper back segment, and a lower back segment.

14. The method according to claim 13, wherein the front segment lies in a first plane, wherein the upper back segment and the lower back segment lie on a second plane substantially parallel to the first plane, and wherein the flap is cut from the second plane and lies on the first plane.

15. The method according to claim 13, wherein the front segment connects the upper back segment to the lower back segment, wherein the first fastener is on the upper back segment and the second fastener is on the lower back segment, and wherein the upper back segment is further connected to the lower back segment by the first fastener and the second fastener.

* * * * *